United States Patent [19]

Vijuk

[11] Patent Number: 4,905,977

[45] Date of Patent: Mar. 6, 1990

[54] COMBINATION COLLATOR FOLDER

[76] Inventor: Robert Vijuk, 1061 Robey Ave., Downers Grove, Ill. 60516

[21] Appl. No.: 192,220

[22] Filed: May 10, 1988

[51] Int. Cl.[4] ..... B42C 1/00

[52] U.S. Cl. ..... 270/45; 270/32

[58] Field of Search ..... 270/201, 32, 37, 45, 270/48, 51–54, 58

[56] References Cited

U.S. PATENT DOCUMENTS

| | | | |
|---|---|---|---|
| 3,265,382 | 8/1966 | Sherman | 270/45 |
| 4,223,882 | 9/1980 | Stocker | 270/45 |
| 4,234,178 | 11/1980 | Beckert et al. | 270/45 |
| 4,512,562 | 4/1985 | Moll | 270/45 |
| 4,616,815 | 10/1986 | Vijuk | 270/45 |

FOREIGN PATENT DOCUMENTS

| | | | |
|---|---|---|---|
| 6629 | 1/1980 | European Pat. Off. | 270/45 |
| 393130 | 4/1974 | U.S.S.R. | 270/45 |

*Primary Examiner*—Robert E. Garrett
*Assistant Examiner*—Therese M. Newholm
*Attorney, Agent, or Firm*—Fitch, Even, Tabin & Flannery

[57] ABSTRACT

A method and apparatus are disclosed for accumulating sheets into a stack and for folding the stack with at least two folds into a "C" or "Z" letter fold. A continuously traveling conveyor travels past a plurality of sheet feeding stations. A sheet is removed from each station simultaneously and these sheets are transferred to a position over the conveyor, and they are stacked directly onto the previously deposited sheets on the conveyor so that simultaneously a sheet is added to each stack at a location opposite each station. Such stack is conveyed to a folding knife which folds the stack off center and leaves a larger unfold portion. At a second folding station, a folding device folds a second fold parallel to the first fold to complete a letter fold for the entire stack of sheets which folded stack is then discharged.

7 Claims, 4 Drawing Sheets

54
42
35
17
17
14a
14b
6A
30
13c
14a
56
56
62
6B
59
14a
64
62
13c
58
13
14b
50
13

54
30
56
56
14a
57

60
52d
13a
62
64
62
58
59

COMBINATION COLLATOR FOLDER

This invention relates to an automatic sheet stacking and folding method and apparatus, and more particularly, to an apparatus having a collator which forms stacks of sheets and a folding device which automatically performs a plurality of folds on the stacked sheets.

The present invention is directed to fast and economic equipment which can be used by people who have a need to make mass mailings of a plurality of stacked sheets which are folded several times with parallel folds. The present invention provides the capability of collating sheets and then folding the sheets into a standard letter fold with two parallel folds dividing the sheet into thirds which are then folded over to form either a "C" or a "Z" type fold, commonly used when mailing letters in envelope. The speeds desired for such equipment are high, and it is particularly, desirous that the equipment be capable of operating at a speed to complete the folding of several thousand folded stacks per hour. Heretofore, this collating of sheets and folding into letters for insertion into envelopes has been done manually. More specifically, a collator has been used to collate the sheets into a stack of sheets, and then manually someone will perform the folding operations and then insert the folded multi-page letter into an envelope. Thus, there is a need for automatic equipment which will efficiently and quickly collate sheets into a stack and fold the stacked sheets with parallel folds and discharge the folded stacks in a condition ready for insertion into a mailing envelope.

Accordingly, an object of the present invention is to provide a collating device which stacks sheets and delivers the same to a folding device which makes several spaced folds in each of the stacks of the sheets.

These and other objects and advantages of the invention will become apparent from the following detailed description taken into connection with the accompanying drawings in which.

Figures 6, 6A, 6B:
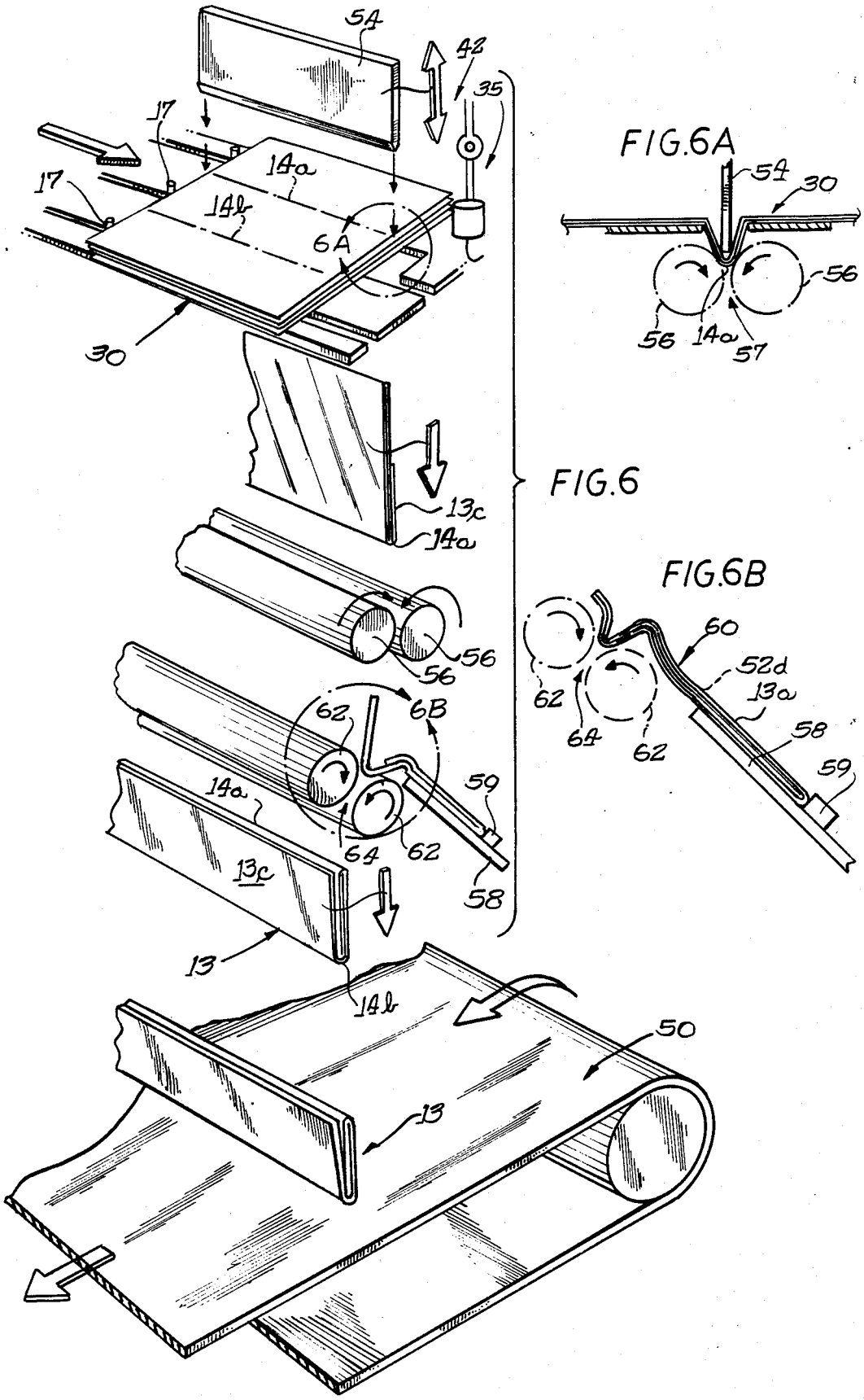
FIG. 6 is a diagrammatic view of the folding elements used for folding the stack.

FIG. 6*a* is an enlarged view taken at the area 6*a* of FIG. 6 showing the folding knife operation.

FIG. 6*b* is view showing the buckling of a sheet making of the final fold with the folding rollers prior to discharge on to the conveyor.

Figure 3:
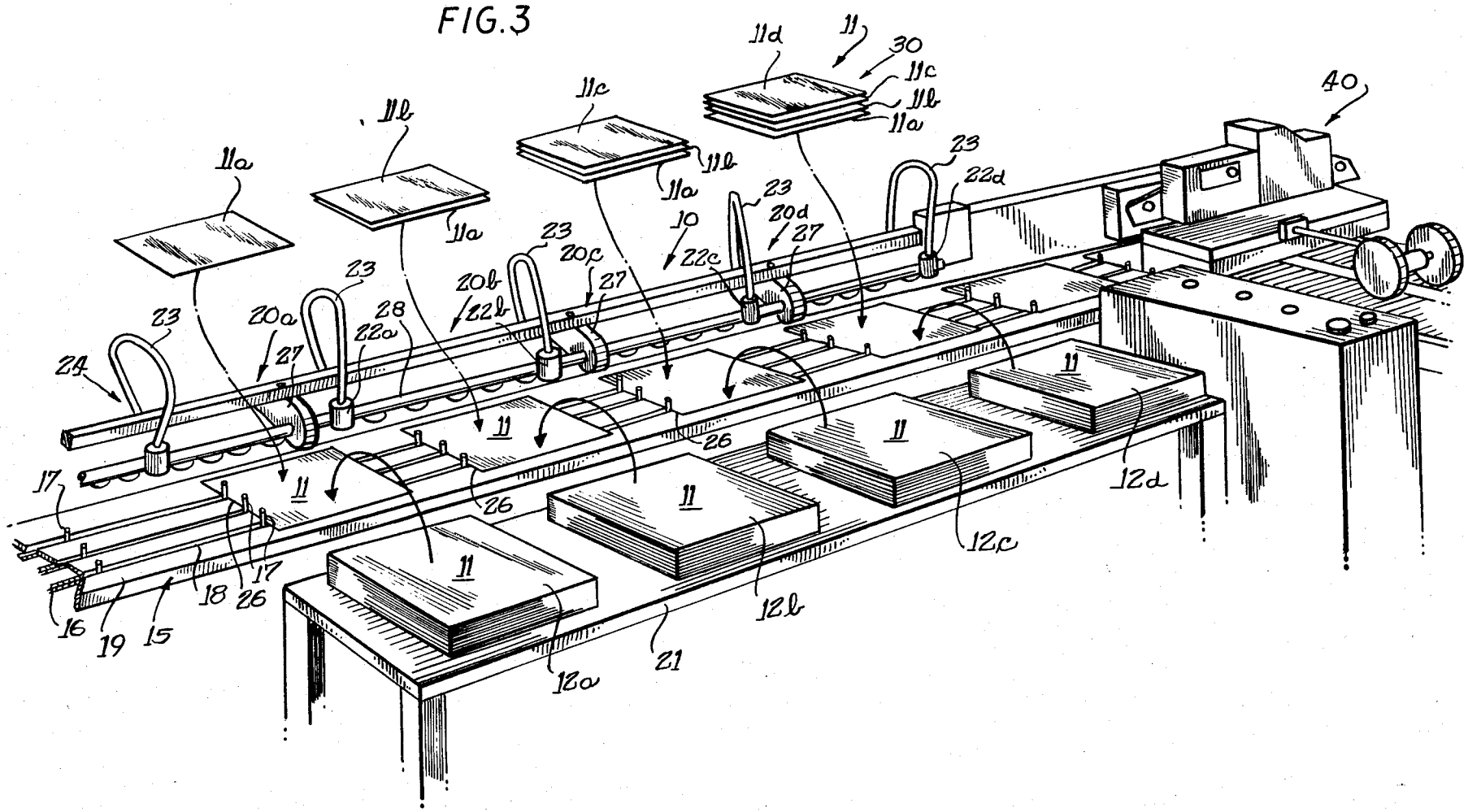
FIG. 3 is a diagrammatic view of a preferred method of collating or stacking sheets and for delivering the same to a folding station.

In accordance with the present invention, there is provided a folding collating apparatus 9 which includes a collator or a collating device 10 which forms a stack of sheets; for example, four sheets as shown in stack 30 in FIG. 3 at the end of the collator and a folding device which folds the stack of sheets with a plurality of folds such that the stack of sheets may be a multi-page letter

Figure 2:
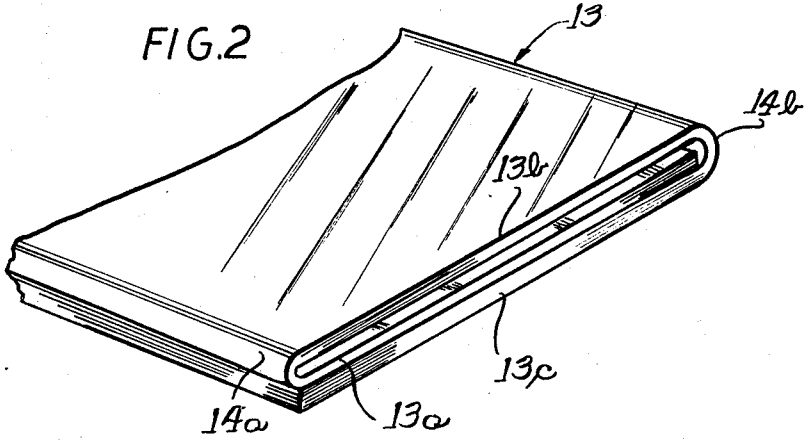
FIG. 2 is a fragmentary view of a folded stack of sheets folded in accordance with the preferred embodiment of the invention with the apparatus of FIG. 1.

13, as shown in FIG. 2, ready for mailing. The multi-page letter 13 shown in FIG. 2 is divided substantially equally into three sections 13*a*, 13*b*, and 13*c*. The inner section is 13*a* is integrally joined at a first fold line 14*a* to an outer section 13*b*, and this section 13*b* extends between the fold line 14*a* and fold line 14*b* which joins the outer section 13*b* to an underlying or loose outer section 13*c*. Thus, the multi-sheet letter, shown in FIG. 2 has three equal sections 13*a*, 13*b* and 13*c* which are superimposed and joined by opposite and parallel fold lines 14*a* and 14*b* to form a common letter fold of sheets. When the folded stack 13 is a letter, it will include a first page 11*a*, a second page 11*b*, a third page 11*c*, and a fourth page 11*d* in proper stacked order. While the sheets are shown in this preferred form, it is to be understood that all of the sections need not be of the same width and that the folded stack of sheets may be something quite different than a conventional letter and still fall within the purview of this invention which is not limited to any particular shape, number of folds or number of sheets to make a finished multi-sheet folded product.

Figure 1:
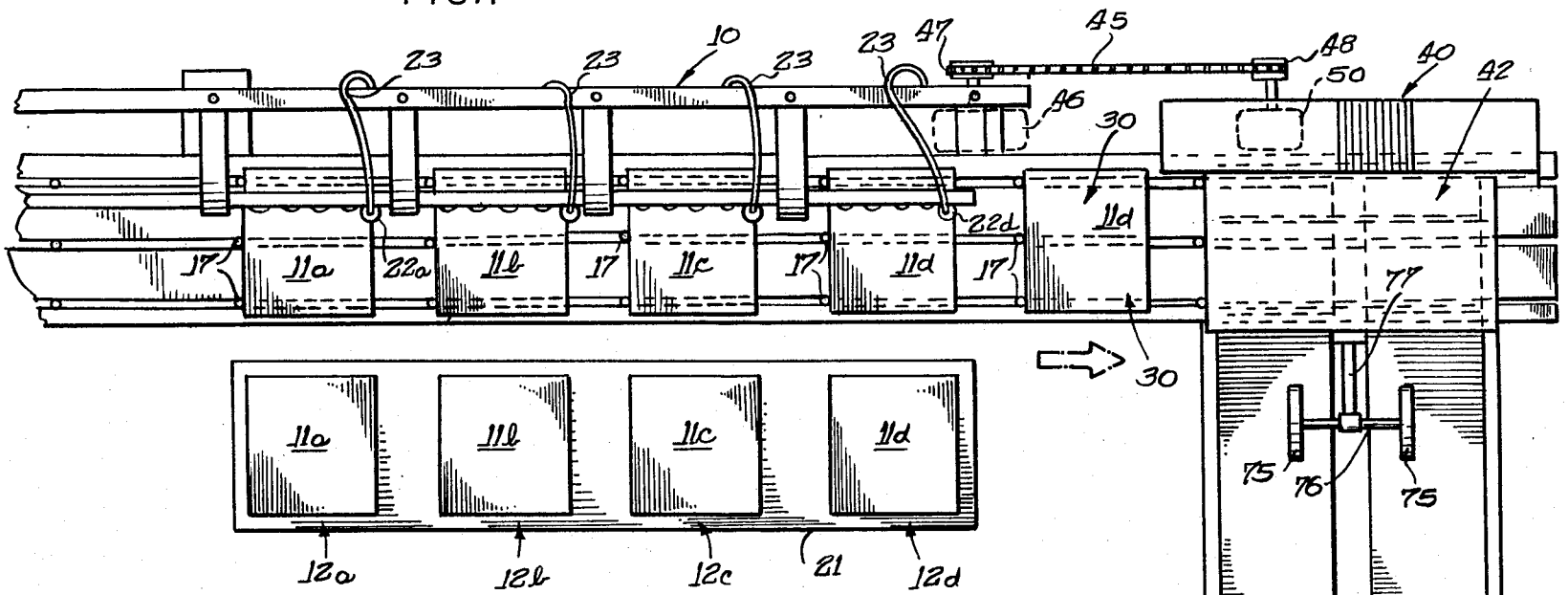
FIG. 1 is a plan view of an apparatus constructed and operated in accordance with the preferred embodiment of the invention.

The collating apparatus as best seen in FIGS. 1 and 3 comprises a plurality of sheets of paper which are provided in piles or stacks 12*a*, 12*b*, 12*c* and 12*d*. Manifestly, the number of sheets to be used in the stack maybe as few as two and maybe considerably more than the four sheets which are used in the stack by way illustration only. The four piles of sheets to be collated are mounted on a suitable support 21, such as a table or horizontal plate which is actually part of the collator 10.

The unfolded stack 30 of sheets is formed automatically on a moving conveyor means 15 having a traveling conveyor chains or belts 16, each of which carries a plurality of vertical, push pins 17. As shown, the push pins 17 are disposed vertically and run in qrooves 18 in a top conveyor support plate 19. The latter is a generally horizontal plate 19 which supports the sheets as they slide across a top surface on the plate in a direction from left to right as viewed in FIGS. 1 and 3 by the conveyor pins 17. As the speed of the movement of the conveyor means 15 is controlled by a drive motor and it moves the accumulating sheets being pushed by the pins 17 at a constant speed past each of a plurality of sheet feeding stations 20*a*, 20*b*, 20*c* and 20*d*. As shown in FIGS. 1 and 3, at each feeding station, a sheet is fitted from a pile 12*a*—12*d* and moved laterally in a direction perpendicular to the movement of the conveyor and deposited on to the top of the conveyor support plate 19 by a series of transfer or pick-off heads 22*a*, 22*b*, 22*c*, and 22*d*. The illustrated pick-off heads are vacuum or suction cups connected to vacuum hoses 23, which are mounted on an oscillating head device 24. The latter includes an overhead bar 26 and a plurality of arms 27*b* which oscillate back and forth with a common bar 28 to which are attached the suction heads 22*a*–22*d* to oscillate the latter from positions over the conveyor 15 to positions directly over the top central portion of each sheet 11 in a sheet pile 12*a*, 12*b*, 12*c* and 12*d* to simultaneously lift four sheets.

In this embodiment of the invention, the four lifted sheets are simultaneously deposited on the traveling conveyor belt 15 immediately preceding the respective four sets of conveyor pins 17 which engage the edge (or edges) of the sheets 11 which have just been deposited. When the conveyor 15 is originally started and empty four bottom sheets 11*a* are deposited simultaneously on to the conveyor. As the conveyor 15 travels to convey the first or left sheet to the second station 20b, the pick-off head oscillates and the pick-off heads 22a–22d lift a second set of sheets 11b of the stack so that each of the stacks will have two sheets. As the first sheet 11a from the stacking station 20a reaches the third stacking station, another sheet 11 will be lifted and deposited to form a third sheet 11c in the stack. Then, the three sheets at the third station 22c move and travel to the fourth station 20d. The pick-off head 22d will have lifted and will be depositing the fourth sheet 11d onto the top of the third sheet stack to complete a formation of a stack of four sheets 30, which sheets are aligned in this instance and are ready for folding.

A completed stack 30 of unfolded sheets is, thus, accumulated in the collator 10 and is carried by the conveyor means from the last sheet feeding station 20d to a folder or folding device 40 which makes the folds 14a and 14b and delivers the folded multi-page letter 13 shown in FIG. 2. The collator 11 is connected and driven in timed relationship with the folding device 40 so that folding operations are timed directly to the conveyor speed and to collating operations such that as each stack 30 arrives into a first folding station 42, there will be a discharge of a folded, multi-page letter 13, shown in FIG. 2, which is ready to be put into the envelope. By way of illustration only, there is shown a timing chain 45, FIG. 1, extending between a collator drive motor 46, which drives a sheave 47 and through the timing chain 45 drives a sheave 48 connected to a motor drive means 50, which drives the folding device 40. Manifestly, the collator and the folding device as well as the conveyor 15 extending therebetween may be connected and driven electronically or in other manners than a direct mechanical drive between the two devices, as illustrated herein. Alternatively, the collator and folder need not be mechanically timed, but the collator must deliver unfold sheet stacks at a speed slower than the maximum folding speed of the folder. A sensor such as an electric eye 35 (FIG. 6) senses the arrival of the stack of sheets 30 at the first folding station and causes a downward movement of a folding knife 54. In any event, the collator and folder are operated so that the arrival at the stacks 30 and the delivery of the finished folded letter 13 is timed such that there is a continuous throughput without interruption in the continuous flow from the collator through the folder. That is, the sheet 11, shown in FIG. 3, at the first station 20a will move at a continuous speed on the conveyor 15 through the collator into the folding device 40 and then will travel through the folding device to discharge onto a discharged conveyor 50 in a manner such that there is no back-up or jamming of any stacks or sheets due to the sheets being fed faster than the folder operates. Manifestly, the speeds of adjustment are provided for both folder and for the collator such that the speed of operation may be varied and adjusted as need be.

The illustrated and preferred folding operation will first be described in connection with a diagrammatic exploded view of FIG. 6, in which in the folder 40 a stack 30 of four sheets has arrived at the first folding station 42 at which the first parallel fold 14a will be made in the stack of four sheets. A photocell device 35 senses the arrival of the stack beneath the knife 54 and the conveyor pins 17 will have finished its conveying and will have been moved downwardly and have begun to return along the conveyor return path at the time that the overhead folding knife 54 is lowered to engage the sheets at what will be the folding line 14a to force the sheets downwardly into the nip of a pair of folding rollers 56. As best seen in FIG. 6a, the knife blade 54 forces the fold line portion 14a into the nip 57 between folding rollers 56, which squeeze and fold the stack to discharge the same as shown in FIG. 6 with a first fold 14a being made across one-third of the length of the stack leaving the remaining panel or two-thirds of the stack. The once folded stack travels downwardly to a folding blade 58 which has the common stop 59, which stops the one-third folded stack, as shown in FIG. 6b, which then buckles at the area of the second fold 14b into the pair of underlying folding rollers 62, which have a common nip 64 therebetween, which forms the second fold 14b, which is parallel to the first fold 14a and is made so that the trailing section 13c is now folded over and leaving the original folded section 13a between sections 13c and 13b.

Figure 5:
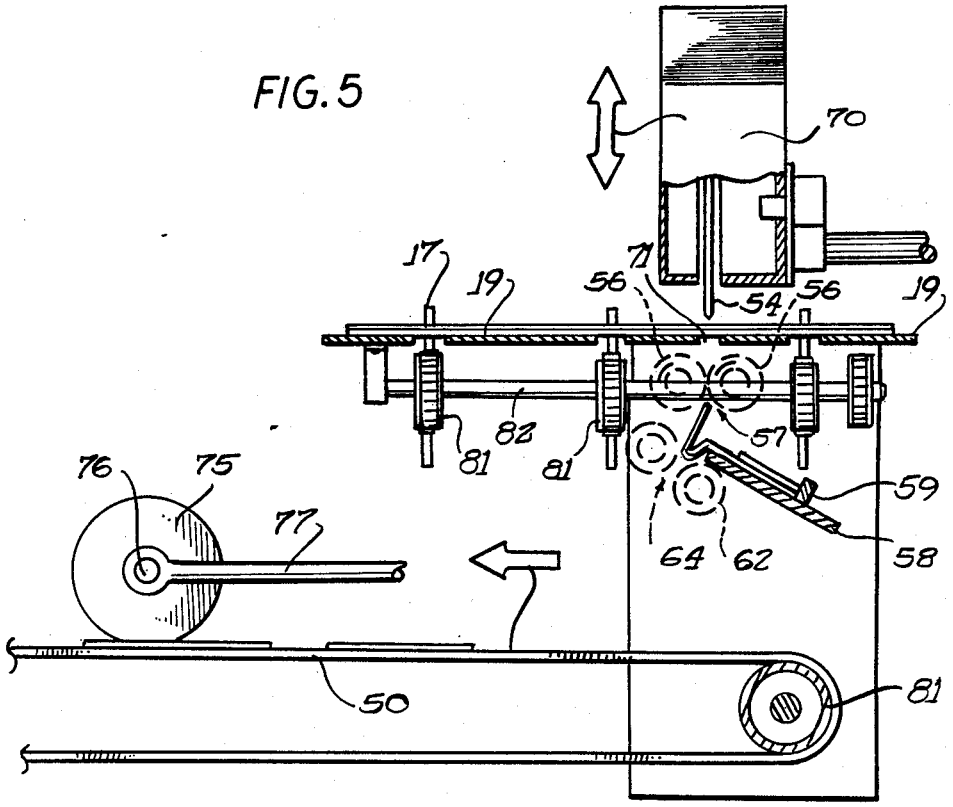
FIG. 5 is a sectional view taken substantially along the line 5—5 of FIG. 4.

As best seen in FIG. 5, the folding knife 54 is mounted in a vertically movable actuator 70 and reciprocates above the supporting conveyor support plates 19, on which the stack 30 of sheets rests immediately above an opening 71 in the plate 70 which is aligned with the nip 57 between the rolls 56 so that when the blade hits the stack at what is to be the fold line 14a, the blade pushes the stack at this fold line 14a through the opening 71 into the nip and then retracts vertically upwardly. Whereupon the gripped stack is pulled downwardly by the folding rollers and are fed directly onto the underlying folding plate 58 with the fold line 14a leading with the folded section 13a being uppermost. In a conventional manner, the remaining two-thirds of the sheet buckle and fall into the nip 64 at the location of the second fold line 14b and are grabbed by the rotating rollers 62 which then forces the same downwardly and completes the folding of the outer section 13c thereby leaving the first folded section 13c inside between the outer sections 13a and 13b.

The now folded, multi-page letter 13 drops down onto the top of the discharge conveyor 50, which is running at right angles to the first conveyor 15 to carry the multi-page, folded letter 13 to the left as viewed in FIG. 5. To maintain the folds close as the letter 13 is transported on the upper run on the conveyor 50, there are a pair of hold-down rollers 75 which are mounted on a suitable axle 76 and held by arms 77 immediately over the conveyor to exert light pressure and to assure that the folds are compressed against each other and will remain in their three-part folded state so that they look much in the manner shown in FIG. 2 when the letters are being discharged.

Figure 4:
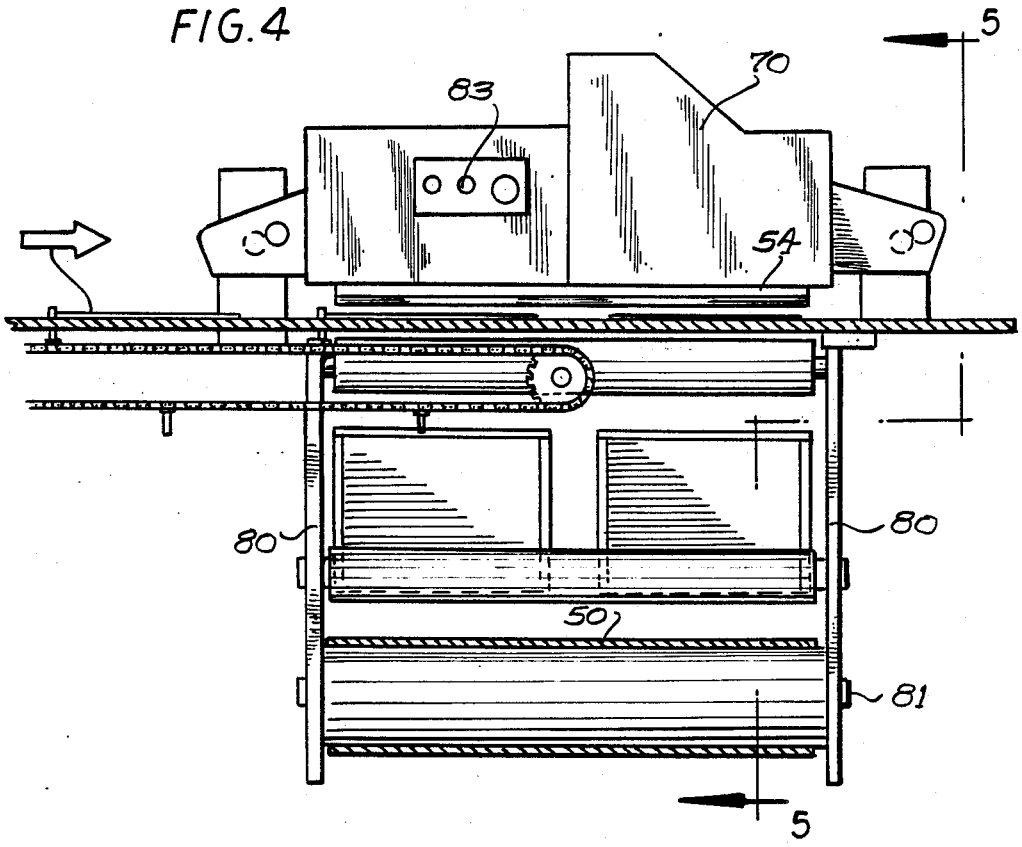
FIG. 4 is a front elevational view of the folding apparatus used to fold the stacked sheets being delivered to it from the collating device.

A more detailed description of the folder discloses that it has a frame 80, as shown in FIG. 4, and has suitable chain sprockets 81 mounted a shaft 82 (FIG. 5) for carrying the conveyor chains 16 which support the pins 17. Supported on the frame 80 is an overhead housing 70 above the conveyor area which houses the folding knife 54. Suitable electrical controls 83 (FIG. 4) are provided for the starting and stopping and the controlling of the speed of the device.

The preferred and illustrated collator may be of the kind made by Kuru and sold under the trademark Kuru Express by Vijuk Bindery Equipment Company of Elmhurst, Ill. The illustrated and preferred collator operates generally in the manner shown in the drawings, and a similar folder may be purchased from Baurle, in West Germany.

Briefly recapitulating, the preferred operation of the apparatus is to provide piles of sheets 12a–12d of sheets.

A sheet is removed simultaneously from each of the stacks by pick-off heads 22a–22d at sheet feeding stations 20a–20d and deposited simultaneously on to a conveyor with the sheets in the second, third, and fourth stations being superimposed over another sheet. The conveyor 15 travels continuously and at a constant rate of speed with the stacks being built up with one sheet at the first sheet feeding station 20a and then with a second sheet 11b being deposited on the sheet 11a at the second feeding station 20b and so forth until there are four sheets built up into a stack 30, shown in FIG. 3, which is being carried into the first folding station 42 in the folding device 40. At the first folding station 51, a folding knife 54 moves downwardly to engage the stack of sheets 30 at a first fold line 14a which is parallel to the direction of travel of the sheets. The fold knife moves downwardly sufficient to insert a first third of the sheets at the fold line 14a into a nip 57 between a pair of folding rollers 56, which pull the stack of sheets downwardly and form a crease or fold at the fold line 14a to form a folded first section 13a and deliver the folded section onto a folding plate 58, which has a stop 59 whereby the trailing upper portions of the sheet stack 30 buckle in a well-known manner at the fold line area into the nip 64 between the folding roller 62, which then completes the second fold 14b. The second fold 14b is parallel to the first fold 14a and the now folded letter 13 is dropped down to a discharged conveyor 50 and a pair of hold-down rollers 75 compress and hold the folded letters against the conveyor belt 50 and the folded letters are then discharged or delivered to automatic insertion equipment, which inserts the same automatically into envelopes.

It will be seen from the foregoing that there is provided a novel apparatus which is capable of operating automatically and continuously to take individual sheets and to form the same into stacks and to feed the stack of sheets into a folding device, which can make parallel folds to divide the stack of sheets into thirds and to fold one panel interiorly much in the manner of the common folded letter and to discharge the same onto a discharge conveyor which will allow removal of the multi-page folded letter in a continuous high-speed operation. The preferred method is capable of handling and folding multiple sheets into multi-page letters at the rate of 3000 or more per hour. Thus, people who want to mass mail letter-like materials, are provided with equipment not heretofore available to them, which equipment is much more economical to them than the manual process heretofore used.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. An apparatus for accumulating sheets into a stack and for folding the stack with at least two folds into a "C" or "Z" letter fold, a conveyor means for traveling continuously in a first direction past a plurality of sheet feeding stations and for conveying sheets, a first sheet feeding means at a first feeding station for feeding a first sheet onto the conveyor means, a second sheet feeding means at a second feeding station downstream of the first sheet feeding station for stacking a second sheet directly onto the first sheet at the second sheet feeding station while the first sheet is traveling to form a stack of sheets on the conveyor means, a first folding means at a first folding station receiving stacks of sheets from the conveyor means, said first folding means comprising a folding knife for engaging each stack of sheets a location off center of the stack and for pushing the stacked sheets to change their direction of travel, folding rollers having a nip to fold the stack of sheets pushed into the nip by the folding knife to make the first fold leaving a larger unfolded portion on the sheets of the stack for forming a second fold in the stack, a second folding means at a second folding station for receiving the stack having the first fold therein and for making the second fold in the larger unfolded portion of the sheets in the stack with the second fold being parallel to the first fold to complete the letter fold in both the first and second sheets, and a discharge means for discharging folded stacks.

2. An apparatus in accordance with claim 1 in which the first and second sheet feeding means each comprise an oscillating pick-off head having suction grippers for gripping sheets, said apparatus including a support means for holding piles of sheets adjacent the conveyor means, said oscillating pick-off heads each removing a sheet from a pile of sheets and carrying the pick off sheets in a direction transverse to the direction of travel of the conveyor means.

3. An apparatus in accordance with claim 1 in which the conveyor means includes an upper run extending between the last of the sheet feeding means and the first folding station.

4. An apparatus in accordance with claim 1 in which the first folding means includes a folding knife and a pair of folding rollers having a nip into which the stack is pushed by the folding knife to make the first fold and in which the second folding means comprises a folding plate and a pair of folding rollers to receive a buckle in the stack to form the second fold.

5. An apparatus in accordance with claim 1 in which the first folding means conveys the stack of sheets downwardly from the conveyor means and in which the discharge means comprises a discharge conveyor moving in a direction at right angles to the conveyor means direction of travel.

6. An apparatus for accumulating sheets into a stack and for folding the stack into a letter fold, a conveyor means for traveling in a first substantially horizontal direction past a plurality of sheet feeding stations and for accumulating a stack of sheets thereon and conveying the stacked sheets, a first sheet feeding means at a first feeding station for feeding a first sheet onto the conveyor means, a second sheet feeding means at a second feeding station downstream of the first sheet feeding station for feeding a second sheet onto the top of the first sheet at the second sheet feeding station to form a stack of sheets on the conveyor means.

a third sheet feeding means at a third feeding station downstream of the second feeding station for feeding a third sheet onto the stacked first and second sheets, said second and third sheets being deposited simultaneously on a first sheet and a second sheet respectively, a first folding means at a first folding station receiving stacks of sheets from the conveyor means and for forming a first fold in the stack, said first folding means comprising a downwardly movable folding knife to engage the folded sheets at a location of about one third of sheet dimension, and a pair of folding rollers beneath the folding knife having a nip, said folding knife pushing the sheet stack downwardly through the nip to cause the folded sheet to travel generally downwardly, a second folding means at a second folding station for receiving the downwardly traveling stack having the first fold therein and for making a second fold in each of the three sheets the stack parallel to the first fold, said second folding means including a folding plate and a pair of folding rollers to make the second fold at about one-third of the sheet dimension and to form the letter fold, a discharge conveyor means for receiving letter folds and for conveying the same away for discharge.

7. An apparatus in accordance with claim 6 including rotating compression rollers to compress the letter folds on the discharge conveyor.

* * * * *

UNITED STATES PATENT AND TRADEMARK OFFICE

CERTIFICATE OF CORRECTION

PATENT NO. : 4,905,977

DATED : March 6, 1990

INVENTOR(S) : Robert Vijuk

It is certified that error appears in the above-identified patent and that said Letters Patent is hereby corrected as shown below:

Column 1, Line 59, after "is" insert --a--.

Column 1, Line 61, change "on to" to --onto--.

Column 2, Line 4, after "section" delete "is".

Column 2, Line 28, after "way" insert --of--.

Column 2, Line 36, change "qrooves" to --grooves--.

Column 2, Line 46, change "fitted" to --lifted--.

Column 2, Line 49, change "on to" to --onto--.

Column 2, Lines 67-68, change "on to" to --onto--.

Column 4, Line 32, after "buckle" delete "and".

Column 5, Line 3, change "on to" to --onto--.

Column 6, Line 27, change "pick off" to --pick-off--.

Column 6, Line 59, change period to comma.

Column 6, Line 65, after "sheet" insert a comma, (second occurrence).

Column 7, Line 3, change "of" to --at--.

UNITED STATES PATENT AND TRADEMARK OFFICE

CERTIFICATE OF CORRECTION

PATENT NO. : 4,905,977

DATED : March 6, 1990

INVENTOR(S) : Robert Vijuk

It is certified that error appears in the above-identified patent and that said Letters Patent is hereby corrected as shown below:

Column 7, Line 4, change "one third" to --one-third--.

Signed and Sealed this

Seventh Day of January, 1992

*Attest:*

HARRY F. MANBECK, JR.

*Attesting Officer*

*Commissioner of Patents and Trademarks*